US005193628A

United States Patent [19]

Hill, III et al.

[11] Patent Number: 5,193,628

[45] Date of Patent: Mar. 16, 1993

[54] METHOD AND APPARATUS FOR DETERMINING PATH ORIENTATION OF A PASSAGEWAY

[75] Inventors: John L. Hill, III, Dale City; Eugene L. Foster; William J. Hutzel, both of Alexandria, all of Va.

[73] Assignee: UTD Incorporated, Newington, Va.

[21] Appl. No.: 709,293

[22] Filed: Jun. 3, 1991

[51] Int. Cl.[5] ..... E21B 7/04; E21B 47/12

[52] U.S. Cl. ..... 175/45; 175/61; 73/151; 367/82

[58] Field of Search ..... 175/26, 45, 67, 61

[56] References Cited

U.S. PATENT DOCUMENTS

| | | | |
|---|---|---|---|
| 3,360,057 | 12/1967 | Anderson | 175/67 |
| 3,693,142 | 9/1972 | Jones | 175/45 |
| 3,718,194 | 2/1973 | Hering et al. | 175/45 |
| 4,303,994 | 12/1981 | Tanguy | 175/45 |
| 4,438,820 | 3/1987 | Gibson | 175/45 |
| 4,804,051 | 2/1989 | Ho | 175/26 |
| 4,848,144 | 7/1989 | Ho | 175/45 |
| 4,930,586 | 6/1990 | Turin et al. | 175/45 |

OTHER PUBLICATIONS

"A New Approach to Directional Survey Interp. and Course Correction by the Sectional Method", R. C. Long, et al., The Engineering Societies Library, pp. 71-83.

"Directional Well Planning with Multiple Targets in Three Dimensions", W. A. Goldman, Chevron U.S.A., Inc., SPE California Regional Meeting held in Bakersfield, Calif., Apr. 5-7, 1989.

"Performance Optimization of Steerable Systems", W. T. Hogg, et al., BP Exploration, Dyce, Aberdeen, Scotland.

"Anadrill Directional Drilling", Anadrill Schlumberger, 1991.

"Smith and Horizontal Drilling", Smith International, Houston, Tex.

"Directional Crossing Systems", Smith International, Houston, Tex.

*Primary Examiner*—Ramon S. Britts
*Assistant Examiner*—Frank S. Tsay
*Attorney, Agent, or Firm*—Dickstein, Shapiro & Morin

[57] ABSTRACT

A method and apparatus are disclosed for determining the position of a centerline of a passageway by using a measuring instrument which passes through the passageway taking periodic and successive axial strain measurements which are in turn used to form an interconnected series of circular arc segments representing the centerline.

26 Claims, 10 Drawing Sheets

METHOD AND APPARATUS FOR DETERMINING PATH ORIENTATION OF A PASSAGEWAY

BACKGROUND OF THE INVENTION

1. Technical Field

The present invention relates to a method and apparatus for accurately determining in three dimensions information on the location of an object in a passageway and/or the path taken by a passageway, e.g., a borehole. It is more particularly directed to a method and apparatus which uses strain measurements taken from a measurement tool which traverses the passageway to obtain the information.

2. Brief Discussion Of Prior Techniques

The drilling industry has long recognized the desirability of having a position determining system which can be used to guide a drilling head to a predestined target location. There is a continuing need for a position determining system which can provide accurate position information on the path of a borehole and/or the location of a drilling head at any given time as the drill pipe advances. The position information must correspond to a starting location and intended target destination. Ideally, the position determining system should be small enough to fit into a drill pipe in a way which will present minimal restriction to the flow of drilling or returning fluids and accuracy should be as high as possible.

Several prior art systems have been devised to provide such position information. Traditional guidance and hole survey tools such as inclinometers, accelerometers, gyroscopes and magnetometers have been used. One problem facing all of these systems is that they are too large to allow for a "measurement while drilling" of small diameter holes. In a "measurement while drilling" system it is necessary to incorporate a position locator device in the drill pipe, typically near the drilling head, so that measurements may be made without extracting the tool from the hole. The inclusion of such instrumentation within a drill pipe considerably restricts the flow of fluids. With such systems, the drill pipe diameter and the diameter of the hole must often be greater than 4 inches to accommodate the position measuring instrumentation, while still allowing sufficient interior space to provide minimum restriction to fluid flow. Systems based on inclinometers, accelerometers, gyroscopes and magnetometers are also incapable of providing a high degree of accuracy because they are all influenced by signal drift, vibrations, or magnetic or gravitational anomalies. Errors on the order of 1% or greater are often noted.

Some shallow depth position location systems are based on tracking sounds emitted by sonde near the drilling head. In addition to being depth limited, such systems are also deficient in that they require a worker to carry a receiver and walk the surface over the drilling head listening to the sound to track the drilling head location. Such systems cannot be used where there is no worker access to the surface over the drilling head.

SUMMARY OF THE INVENTION

The present invention is designed to provide a highly accurate position determining system which is small enough to fit within drill pipes of diameters substantially smaller than 4 inches and in a configuration allowing for smooth passage of fluids. The invention in both its method and apparatus aspects successively and periodically determines the radius of curvature and azimuth of the curve of a portion of the drill pipe from axial strain measurements made on the outer surface of the drill pipe as it passes through a borehole or other passageway. Using the successively acquired radius of curvature and azimuth information, the invention constructs on a segment-by-segment basis circular arc data representing the path of the borehole and which also represents, at each measurement point, the location of the measuring strain gage sensors. If the sensors are positioned near the drilling head, the location of the drilling head is obtained.

The invention has been found to provide a system which is much smaller than conventional systems, is easily provided within a smaller diameter drill pipe, and is less expensive than other systems. In addition, it has been found to be more accurate than other position determining systems because the measuring system is not subject to drift and is insensitive to local variations in the earth's magnetic and gravitational fields. In addition, since the present invention is based on the measurement of strains in a portion of the drill pipe, and the absolute magnitude of those strains increases for a given radius of curvature as the diameter of the drill pipe increases, the accuracy of the system increases with larger drill pipe diameters.

The invention is also not affected by the presence of nearby metallic structures, electrical wires or gravitational anomalies which may affect position location systems based on the use of magnetometers or gyroscopes.

The invention is also not depth limited, and is capable of being monitored fully from the origination of the borehole, and can therefore be used in areas where access to an area over the drilling head is not possible.

The invention also does not require the same level of sophisticated care as do systems based on accelerometers and gyroscopes which have strict acceleration limits. The present invention can be implemented in a solid state design which permits rugged handling and easier and cheaper repair.

The invention has particular application for directional drilling and can be used with various types of drilling apparatus, for example, rotary drilling, water jet drilling, down hole motor drilling, and pneumatic drilling. The invention is particularly useful in directional drilling such as for well drilling, reservoir stimulation, gas or fluid storage, routing of original piping and wiring, infrastructure renewal, replacement of existing pipe and wiring, instrumentation placement, core drilling, cone penetrometer insertion, storage tank monitoring, pipe jacking, tunnel boring and in other related fields.

The present invention is also not restricted to the field of borehole drilling as it has wider applicability to the general field of surveying passageways. For example, the invention has applications in the medical field in surveying body passages such as intestinal tracts or arteries during real time operations or when sonogram, x-ray and magnetic techniques are not medically advisable. It may also be used to locate the path of a pipe or other conduit, in vehicles, machines, buildings, other structures, or underground.

In addition to the benefit of providing a larger clear central area in the drill pipe for borehole drilling, the present invention can also be used in the presence of ground water or drilling fluid without harmful effects.

The present invention also has advantages over optical position locating techniques as it can be used in the presence of ground water or drilling fluid where optical systems are inoperative because of the opacity of the water.

The position information from the present invention may be transmitted by wire or wireless means to a location remote from the drilling operation for processing. In the invention, the position information can be used either to display the real time position of a drilling head, or to plot in three dimensions the path of a borehole or other passageway, or to supply position information to a steering system for the drilling head for automated midcourse drilling corrections.

The foregoing objects, advantages and features of the invention are achieved by providing a method for determining, in three dimensions, the location of a centerline and/or terminus of a passageway, comprising the steps of passing a measuring instrument through the passageway; determining the local radius of curvature of the instrument and the associated azimuth of the plane of curvature with respect to the instrument at each of a plurality of measurement points as the measuring instrument traverses the passageway; forming a circular arc segment in three dimensional space for each determined local radius of curvature; and constructing a three dimensional representation of the centerline of the passageway by sequentially connecting end-to-end the circular arc segments.

The local radius of curvature measuring sequence may further comprise the steps of measuring the axial strain in the walls of a measuring tube section at a plurality of points around the circumference of the tube, at a given cross sectional plane of the tube taken 90° to the axis of the tube, and transforming the measured axial strain into a local radius of curvature measurement. The associated azimuth is obtained by the steps of comparing the actual strain measurements to reference data and determining the deviation of the actual strain measurement with respect to the reference data.

The sequential end-to-end connection of the circular arcs is started at an initial point which represents a determination of the initial entry point and attitude of the passageway which is used to begin the construction of the three dimensional centerline representation. Information on the initial entry point and attitude can be manually measured and manually set into the invention or it may be automatically measured and set into the invention.

The invention also provides a method for compensating for rotation of the measuring tube during a drilling operation by determining, at each measurement position, information concerning the net amount of rotation relative to a global reference, if any, of the measuring tube as it passes through the passageway and using the rotation information together with the strain measurement to determine the azimuth associated with a measured local radius of curvature relative to the global reference.

The invention also provides a method for controlling a directionally controllable drilling tool with determined three dimensional location information so as to guide the drilling tool to a target drilling location.

The invention also provides an apparatus for implementing the position location methods described herein. In one aspect, an apparatus is provided for determining in three dimensions the location of a centerline and/or terminus of a passageway comprising means for determining the local radius of curvature of a measuring instrument and an associated azimuth of the plane of curvature with respect to the measuring instrument at each of a plurality of measurement points as the measuring instrument traverses the passageway; means for forming a circular arc segment in three dimensional space for each determined local radius of curvature; means for storing data representing the circular arc segments; and means responsive to the stored data for forming a three dimensional representation of the path of the centerline of the passageway.

The above and other objects, features and advantages of the invention will be more clearly understood from the following detailed description of the invention which is provided in connection with the accompanying drawings.

DETAILED DESCRIPTION OF THE INVENTION

Figure 1:
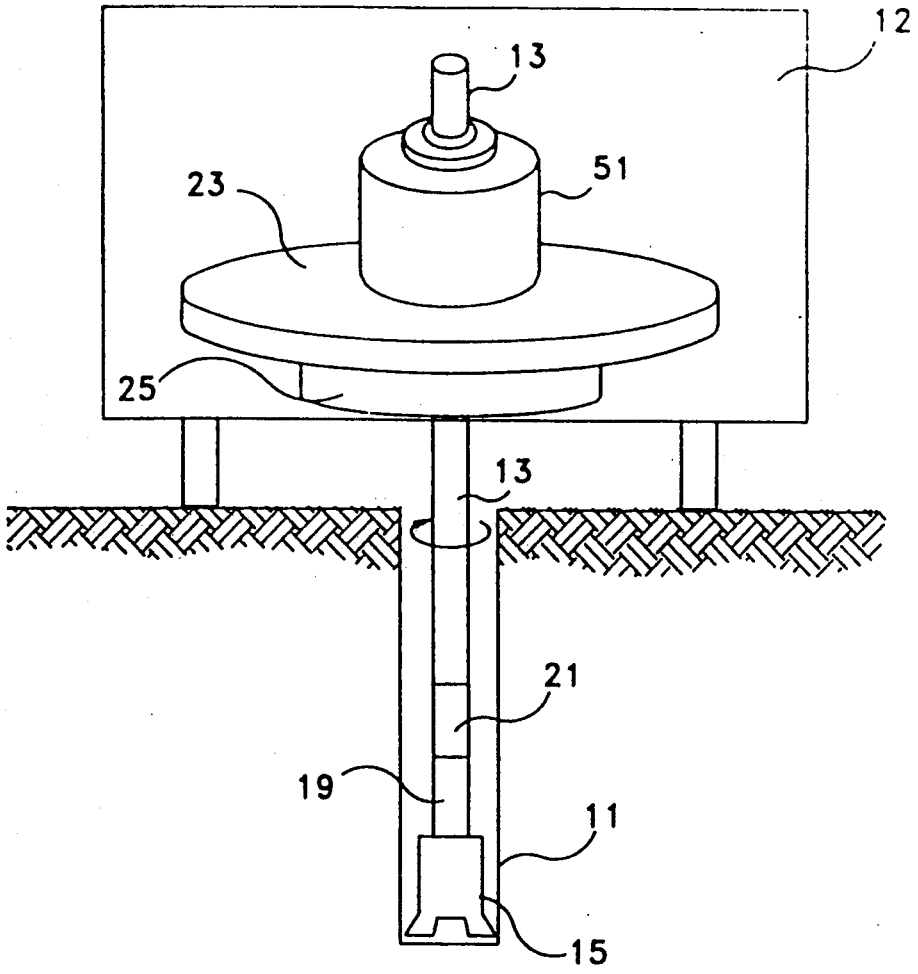
FIG. 1 is a schematic drawing showing one environment of use for the present invention.

FIG. 1 illustrates in schematic form a borehole 11 which is under excavation by a drilling apparatus including a drilling head 15 connected by drill pipe 13 to surface drilling equipment 12 located at a surface drilling location. At the surface drilling location, the drill pipe 13 may be connected to a conventional rotary drill table 23 through a hydraulic thruster 25. These items may be truck mounted or provided at a stationary surface location. The details of the construction of a particular surface drilling equipment 12 for advancing the drill pipe 13 are omitted since the invention is not in the drilling equipment, per se, but in a method and apparatus for determining the position of a centerline path and/or terminal end of a borehole or other passageway.

Drill pipe 13 includes a section near drilling head 15 containing a position measuring apparatus used in the invention in the form of a forward measuring module 19 and a trailing measuring module 21. Each of the measuring modules 19, 21 is preferably constructed as a rigid tubular portion of drill pipe 13. The two measuring modules 19 and 21 are non-twistably connected, that is, the two modules are connected such that the relative azimuthal alignment between them remains constant during operation. Each of the forward and trailing measuring modules 19 and 21 has strain gage sensors positioned therearound which form an important aspect of the invention. Since the construction and operation of the measuring modules is identical, only one (19), is now described in greater detail with reference to FIGS. 2A and 2B.

Figure 2A:
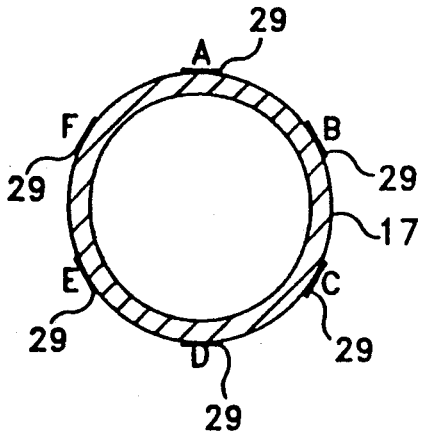
FIGS. 2A, 2B respectively illustrate in end and perspective view a tubular section of a drill pipe having attached strain sensors which is used as a measuring instrument in the present invention and which is also referred to as a measurement module.
Figure 2B:
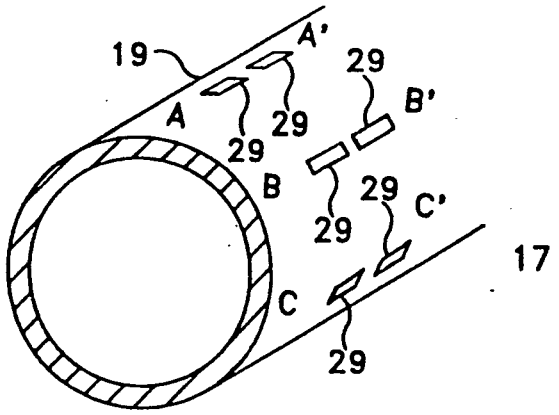

As shown in FIGS. 2A and 2B, the measuring module 19 is formed as a tubular member 17 made of a rigid material such as the same material as used in the drill pipe 13. A plurality of strain gage sensors 29 are spaced about the circumferential periphery of measuring module 19. The strain gage sensors 29, as shown in FIG. 2A, are arranged in opposing pairs so that there is a pair of strain gage sensors on opposite sides of the tubular member 17, i.e. spaced 180° from each other. As illustrated in FIG. 2A, these pairs are denoted A-D, B-E and C-F. Although three pairs of strain gage sensors are illustrated, a greater number of pairs can be employed. As illustrated in FIG. 2A, the strain gage sensor pairs A-D, B-E and C-F are arranged to have 60° increments between adjacent sensors about the circumference of the measuring module 19.

FIG. 2B also illustrates a modification in which at least one additional strain gage sensor A', B', C' . . . is associated with each of strain gage sensors A, B, C, etc. Each of the additional sensors is spaced a short distance along the length of the tubular member 17 relative to a corresponding strain gage sensor A, B, C, etc. The additional sensors A', B', C' . . . are wired in series with respective sensors A, B, C . . . to increase the detected signal output from the strain gage sensors. If desired, additional sensors A", B", C" . . . (not shown) may also be spaced a short distance from respective sensors A', B', C' . . . along the length of tubular member 17 and wired in series with sensors A, A' . . . etc. to further increase signal strength.

The strain gage sensors illustrated in FIG. 2A are mounted on the outside circumferential surface of the tubular member 17, but it should be appreciated that the sensors may also be mounted on the interior peripheral surface instead. It is preferable, however, to provide the strain gage sensors on the exterior surface to permit an unencumbered flow path on the interior of the measuring module 19 thereby permitting the passage of drilling fluid down to a drilling head 15. An additional advantage to exterior mounting is that it provides a maximum distance between the sensors and the center of the measuring module 19 and thus a greater strain value, thereby increasing measurement accuracy.

The strain gage sensors, whether mounted inside or outside, are sealably protected by an overcovering material. In addition, the sensors are sealably encapsulated and may be located within depressions formed in the exterior or interior surface of tubular member 17.

The strain gage sensors A...F are used to detect bending in the tubular member 17 as it traverses a borehole 11. The bending deflection of the tubular member 17 occurs due to the trajectory of the drill string 13 in the borehole which the tubular member 17 traverses and is related directly to the strain in the tubular member. Accordingly, by incrementally pushing the measuring module 19 into a passageway and measuring this bending strain and an associated azimuth for the plane in which the bend occurs, forming a circular arc representing the bending deflection in three dimensions for each push and associated measurement, and successively connecting end-to-end the circular arcs as each is formed, a very accurate determination of the position of the measuring module 19 as it passes through the passageway is obtained.

Figure 3:
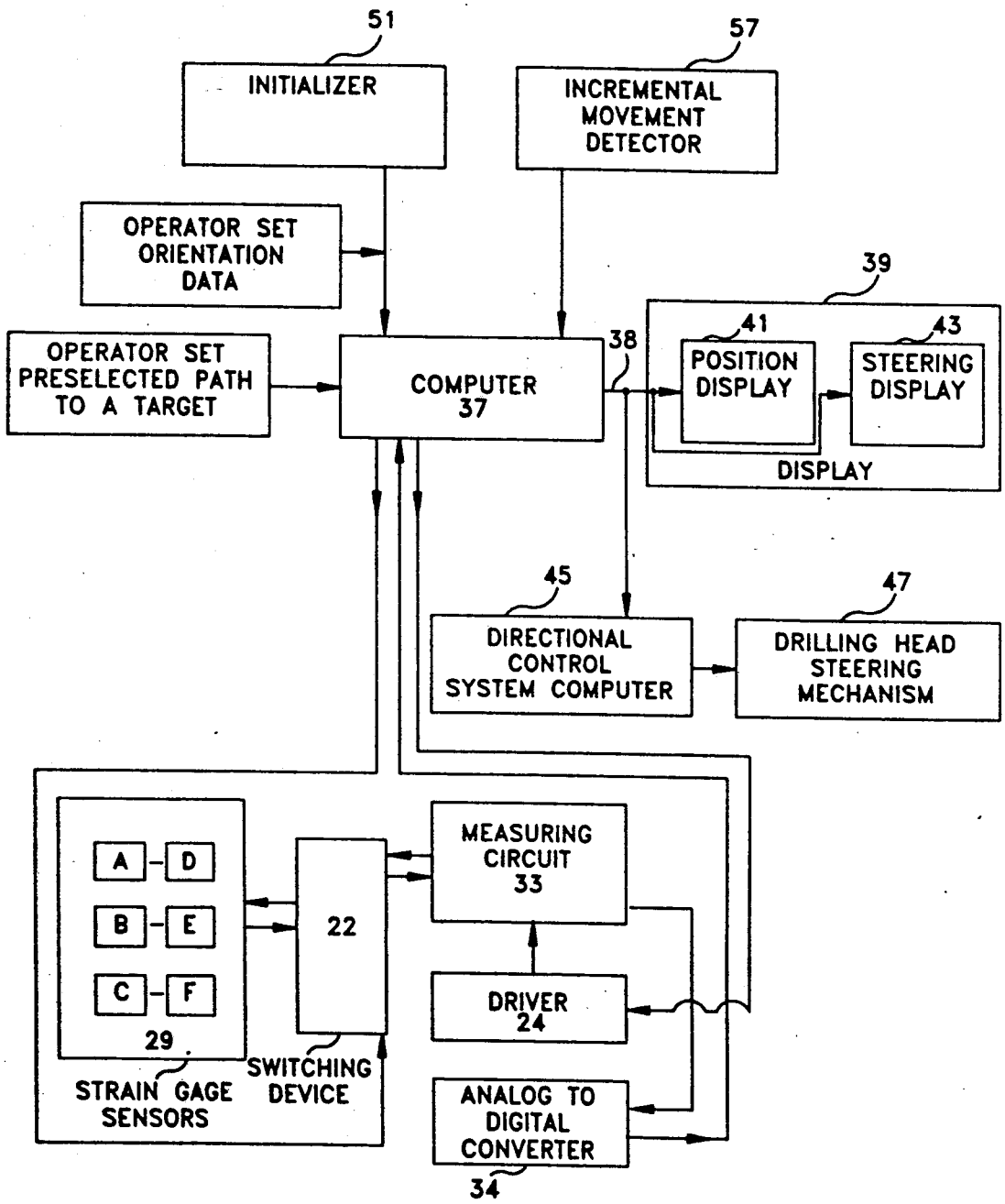
FIG. 3 is a schematic drawing of an entire position locating apparatus of the invention.
Figure 4:
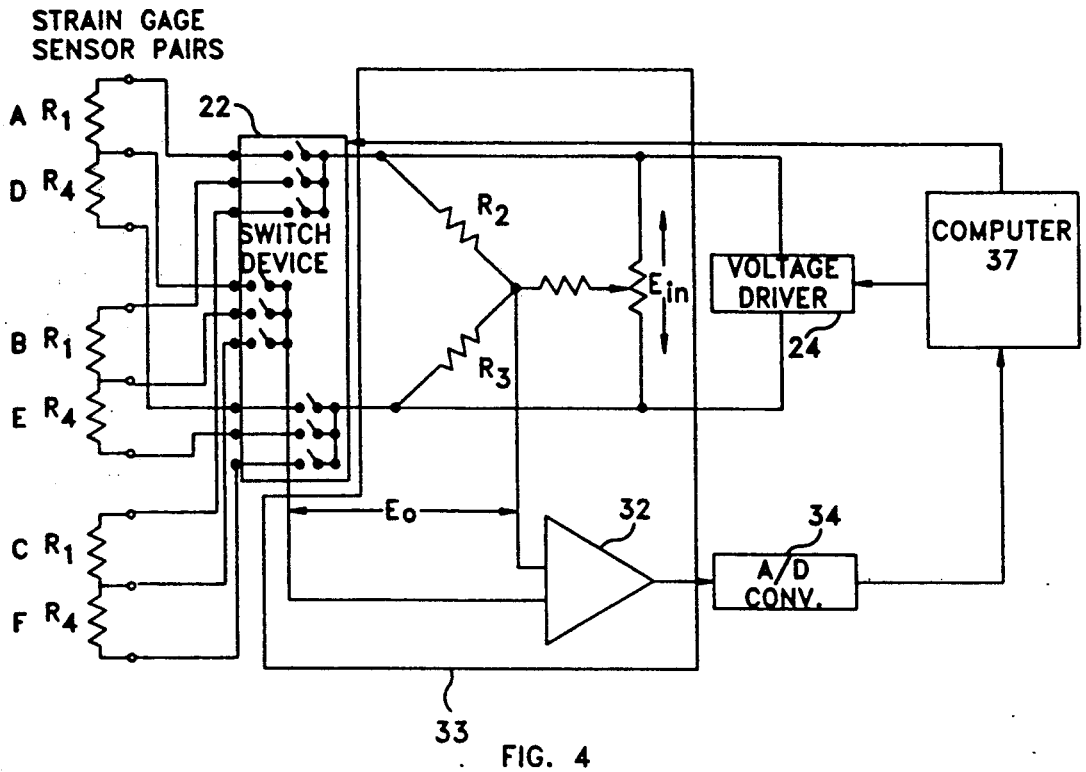
FIG. 4 is a schematic drawing of a strain measuring circuit used in the invention.

The manner in which the strain gage sensors are employed in the apparatus of the invention to develop positional information is illustrated in FIGS. 3 and 4. Each of the strain gage sensors 29 is connected through switching device 22 to a measuring circuit 33 consisting of a Wheatstone bridge which is in turn connected to a digitizing analog-to-digital converter 34. The measured strain data output from sensors A and D (or A+A' and D+D', if A' and D' are used), etc. is measured by a measuring circuit 33 and digitized by the analog-to-digital converter 34 and sent as a stream of digital data to computer 37. Computer 37 controls the switching device 22 to sequentially connect each of the pairs of strain gage sensors A-D, B-E, C-F (denoted as R1 and R4 sensor pairs in FIG. 4) to the measuring circuit 33 having reference resistors R2 and R3. The bridge circuit is balanced when R1=R2=R3=R4. While each sensor pair is connected to the measuring circuit 33, the circuit is energized by a driving input voltage $E_{in}$ applied under control of computer 37 through driver 24 to thereby produce a respective output voltage $E_o$ to an amplifier 32 contained in measuring circuit 33. This output voltage is converted into a digital signal by analog-to-digital converter 34 and applied as input data to computer 37. In this manner, computer 37 acquires data representing the amount of differential strain $\Delta e$ measured by each pair of sensors since the connection of the resistances R1 and R4 in the measuring circuit 33 produces a differential output signal $e_o$ which equals, for sensor pairs A, D, the signal $e_A - e_D$, where $e_A$ and $e_D$ are the strains respectively measured by strain gage sensors A and D.

Figure 5:
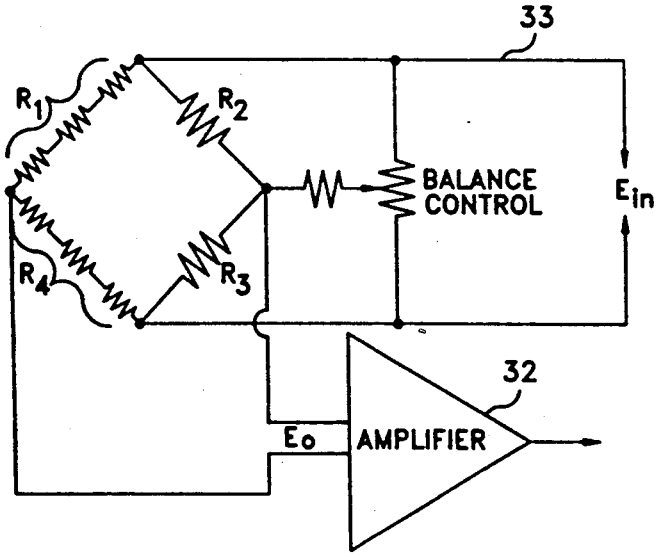
FIG. 5 is a schematic drawing of a modification of the FIG. 4 circuit.

FIG. 5 shows the Wheatstone bridge portion of the FIG. 4 circuit as modified to accommodate a plurality of sensors (e.g. three, A, A', A") wired in series.

Computer 37 acquires the strain gage sensor measurements received from analog-to-digital converter 34 for each push of a drill pipe and converts these measurements into data representing a radius of curvature and azimuth orientation for a bending deflection in the measuring module 19 at a measurement location in borehole 11. As the measuring module 19 is successively pushed an incremental amount into the passageway, and new strain gage sensor measurements are taken at each point they are used with acquired drill pipe insertion length data from incremental movement detector 57, to form successive circular arcs. The interconnected series of successive circular arcs provides historical data on the centerline of the passageway as well as providing the present location of the measuring module 19 which is at the last measurement position.

The computer 37 also receives initial information on the entry orientation of the drill pipe 13 into the ground from initializer 51 relative to a global orientation system and constructs, from this initial information and on a segment-by-segment basis, the path and location information for the measuring module 19 as it passes through the borehole. The construction of initializer 51 is described in greater detail below As also shown in FIG. 3, the output 38 from computer 37 provides information on the path taken and current location of measuring module 19 as it passes through the borehole. This output is supplied to a display system 39 which includes a position display device 41 which displays in x, y, and z or polar or other coordinates, and with an insertion length measurement, the instantaneous and previously mapped position of the measuring module 19. In addition, the display system 39 further includes a display device 43 which shows a present position of the measuring module 19 relative to a desired preselected path to a target. Information from the display device 43 can be used, among other ways, by an operator to steer the drilling head 15 towards a desired target location.

The data output from computer 37 may also be supplied to a directional control system 45 which develops control signals to automatically control directional movement of drilling head 15 so that it moves along its desired preselected path to a target. The control signal output from the directional control system 45 in turn is supplied to the steering mechanism 47 of drilling head 15. Since drilling head steering mechanisms, per se, are well known in the art, a detailed description of their operation is not provided here. However, attention is directed to the following U.S. Pat. Nos. all of which incorporate a controllable direction drilling head 47 which could be controlled by the output of the directional control system computer 45:

3,360,057
4,438,820
4,930,586

Figure 6:
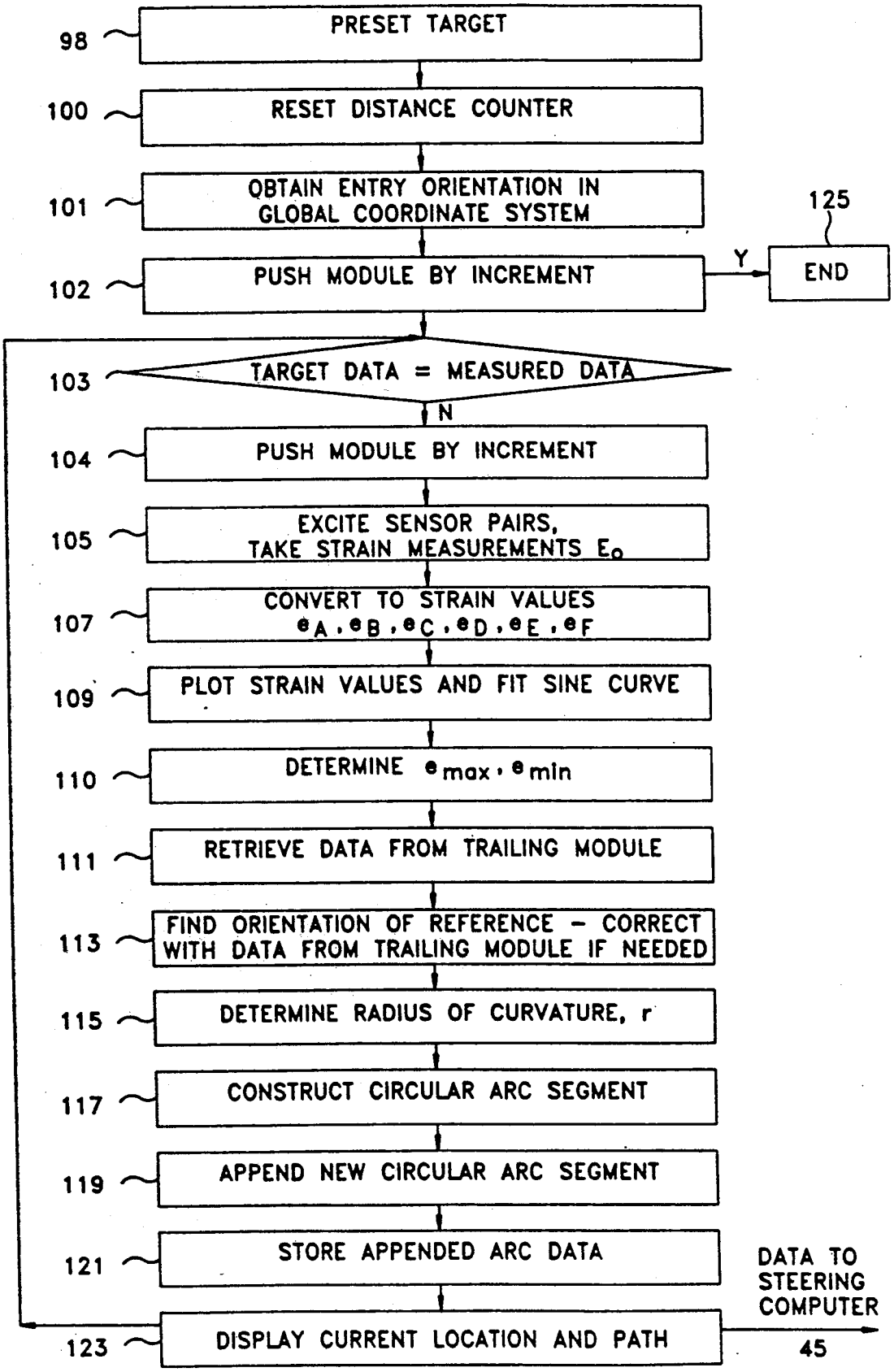
FIG. 6 is an operational flow chart for position location which is executed by the apparatus illustrated in FIG. 3.

The manner in which the FIG. 3 apparatus operates to acquire and plot present and past position information is illustrated in the processing flow chart of FIG. 6. Preset target data are first entered by an operator at step 98 via a keyboard or other convenient entry device. After an increment distance counter is reset to zero in step 100, computer 37 obtains, in step 101, initial global orientation information at the entry of the drill pipe 13 to the borehole 11. This information can be measured and manually entered by an operator through a keyboard or other entry device, or may be provided automatically by an initializer 51 located at the borehole entrance. The initializer 51 automatically determines the global orientation information for the measuring module 19 as it enters the ground. This information tells computer 37 the exact ground entry trajectory of the measuring module 19 so that computer 37 may properly append the first measured and calculated path data to the initial global orientation data.

Figure 7:
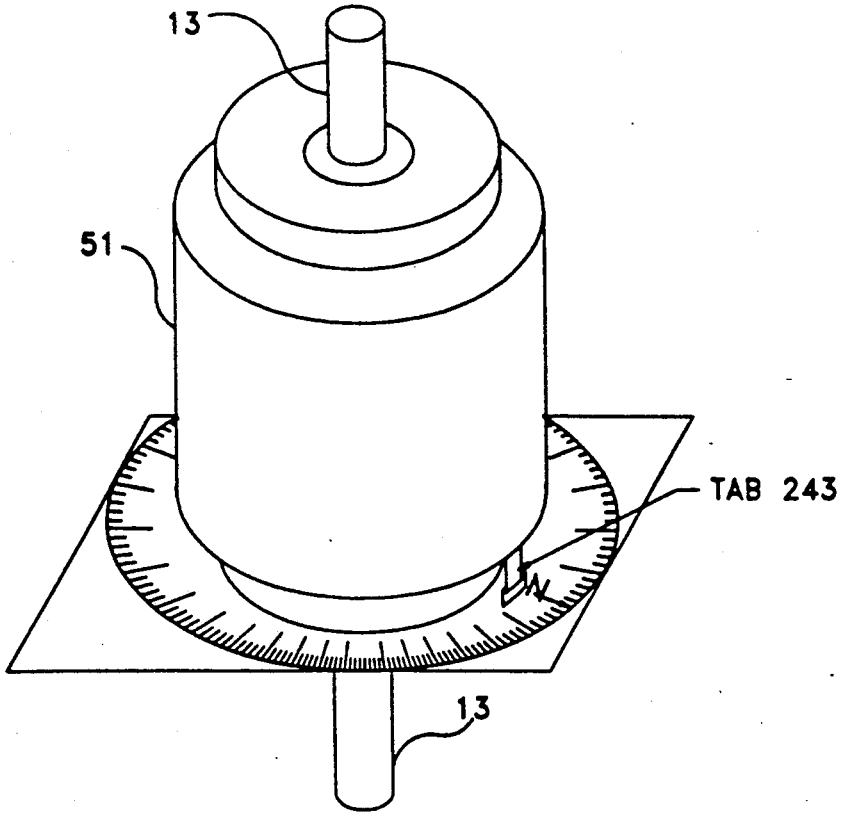
FIG. 7 is a perspective view of an initializer (initial orientation detector) for use in the present invention.

FIG. 7 illustrates an initializer 51 which may be used to provide initial orientation information relative to standard surface survey references, i.e. the earth's gravitational and magnetic fields. The FIG. 7 initializer determines the location of the point of entry into the ground, either with respect to a geodetic grid or a reference object and provides the three dimensional origin to which all subsequent measurements will be indexed. FIG. 7 shows use of the initializer as applied in the launching of drill pipe 13 into the ground from the bed of an instrumentation truck, the position of which has been "surveyed in" relative to a local survey grid, although the truck is not essential to the functioning of the initializer 57.

The information needed to define the initial conditions at drill pipe insertion includes the entry angle of the measuring module 19 axis, the azimuth of the intersection of the vertical plane through the hole axis, and the location of a reference strain gage sensor (one of the sensors A–F) with respect to an azimuth reference. This information is obtained from the initializer 51. The way in which this is done is now described with reference to FIGS. 7 and 8.

Figure 8:
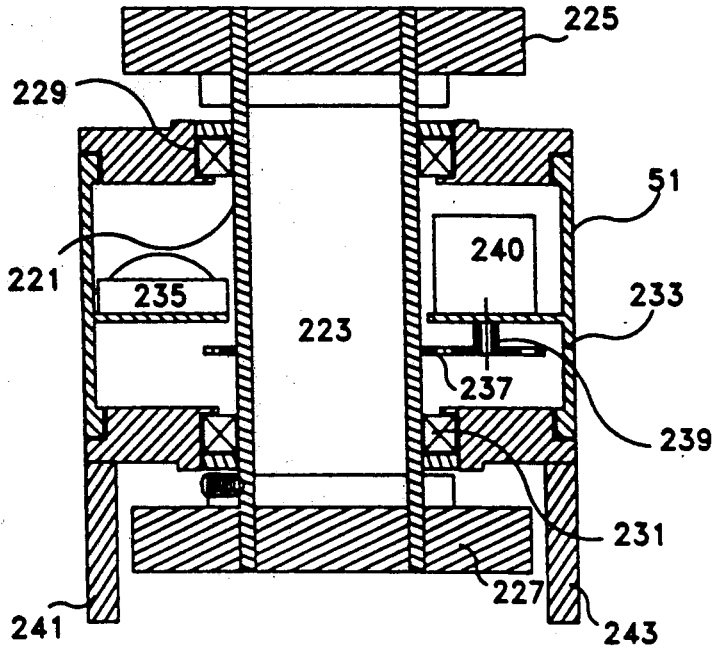
FIG. 8 is a cross-sectional view of the internal components of the initializer (initial orientation detector)

FIG. 8 shows a schematic drawing of the functional parts of the initializer. Passing virtually through the center of the initializer is a tube 221 having a clear opening 223 slightly larger than the diameter of the drill pipe 13. This provides a space through which the drill pipe and the measurement module 19 pass when the initializer 51 is in place as a bore hole is being started. Mounted on the top and bottom ends of the tube 221 are two centering chucks 225 and 227. Each of these is drawn tight against the measurement module, which engages a longitudinal groove which assures that the tube 221 has a known orientation (its azimuth about the pipe with respect to a reference strain gage sensor). Thus, when the top and bottom clamps of chucks 225 and 227 have been set, they have centered the initializer 51 on the measuring module, and they have located it precisely in azimuth with respect to the strain gages sensors.

Attached to the central tube 221 by two preloaded bearings 229 and 231 is a cylindrical body 233. This body is the mounting platform for the electronic instruments incorporated into the initializer. As shown at the left in FIG. 8, a dual axis clinometer 235 is mounted on a bracket from which it can provide an output showing the tilt of the axis in each of two orthogonal planes. This enables the system to calculate the angle between the measurement module 19 and the gravity vector.

A large precision gear 237 is attached to the outside of the tube as shown in FIG. 8. This meshes with and drives a pinion 239 attached to the shaft of an optical encoder 240. This instrument produces 4800 pulses per revolution. Since it is geared by a ratio of 3:1, one complete rotation of the central tube 221 produces 14,400 pulses. Thus, tube 221 azimuth can be measured to an accuracy of 360/14,400 or 0.025° with respect to the azimuth of the initializer body 233.

Two tabs 241, 243 engage recesses in the floor of an instrumentation truck bed or ground plate for example which has been surveyed in place, both for grid position and for direction (azimuth), the tabs establish a reference azimuth for the initializer body 233. Once the body 233 has been oriented, the output of the optical encoder 240 can be read into computer 37 to indicate the azimuthal orientation of the central tube 221. This can be related to the azimuthal locations of the vertical plane through the measuring module 19 axis and of the strain gage sensors. The output of the dual axis clinometer is also applied to computer 37. Thus, initializer 51, used in conjunction with a surveyed reference, provides full information to computer 37 about the initial path of the measuring module as it enters the ground. These are the starting conditions from which all subsequent calculations will proceed. The initializer 51 provides the necessary initial coordinate information to transform the position location coordinates (x, y, z) developed in the invention to a conventional engineering survey reference system on the surface.

FIG. 7 illustrates the initializer in use. It will be seen to fit over drill pipe 13 and measuring module 19 and to engage its tab 243 in holes in the instrumentation truck bed or other ground reference. FIG. 7 indicates that an azimuth reference exists on the truck bed by showing a compass rose with North labeled on the plate.

Returning to FIG. 6, once the initial global orientation information is received from initializer 51 by computer 37 at step 101, the measuring module 19 is incrementally advanced into the passageway at step 102 and computer 37 receives an incremental push signal from detector 57 and stores an insertion length increment for the drill pipe 13. The computer then checks at step 103 to determine if the target location has been reached by comparing whether the last measured position coincides, within predetermined limits, with a present target location. If the answer is yes, the procedure ends at step 125. If no, the drill pipe 13 advancing equipment pushes the drill pipe into the ground by another incremental amount in step 104 and computer 37 receives an incremental push signal from detector 57 and stores the new insertion length of the inserted drill pipe 13. After the drill pipe has advanced by the incremental amount, the strain gage sensors A . . . F in the measuring module 19 are excited in pairs by the application of a driving voltage $E_{in}$ applied to the measuring circuit 33 (FIG. 3) to obtain measured output voltage $E_o$ (FIG. 4) at step 105. This voltage measurement is digitized by analog-to-digital converter 34 and sent to computer 37. After computer 37 receives the respective digitized output voltage $E_o$ for each pair of strain gage sensors (A-D, B-E, C-F), it proceeds to step 107 where it transforms the measured voltages $E_o$ into individual strain measurements $e_A$, $e_B$, $e_C$, $e_D$, $e_E$, $e_F$ using the relationship $$\frac{K \cdot E_o (A - D)}{2} = e_A = -e_D \quad (1)$$

$$\frac{K \cdot E_o (B - E)}{2} = e_B = -e_E \quad (2)$$

$$\frac{K \cdot E_o (C - F)}{2} = e_C = -e_F \quad (3)$$

where K is the strain gage factor. Next, in step 109, computer 37 plots the strain values $e_A$, $e_B$, $e_C$, $e_D$, $e_E$, $e_F$. Since the strain around the periphery of a bent circular tube varies according to a sine wave, as shown in FIG. 9B, computer 37 then mathematically fits a sine wave to the measured strain data points, as graphically illustrated in FIG. 9A. Once the curve fit is completed, computer 37 then finds the location of the deviation of the data from sensor A on the curve from a reference phase (e.g. 0°). Since the strain gage sensors are 60° apart, this is done by solving the equation $$\frac{e_A}{e_B} = \frac{\sin A(\delta)}{\sin (60^\circ + A(\delta))} \quad (4)$$

for A(δ). This then provides the phase location of a measuring point A on the sine curve and its deviation from the reference (e.g. 0°) and provides the orientation of the plane of curvature as measured by measuring module 19. The maximum value of the strain can also now be found by the equation $$e_A = e_{max} (\sin A (\delta)) \ldots \quad (5)$$

Since A(δ) is known from step 109, and $e_A$ is known from step 107, the value $e_{max}$ can be determined in step 110. Step 111 accepts strain measurement data from trailing measuring module 21 and step 113 uses these data to maintain proper orientation data when the drill pipe rotates. This will be described in greater detail below.

Computer 37 next calculates in step 115 the radius of curvature of the measured bend in the measuring module 19 using the obtained strain data. Following this, in step 117, computer 37 constructs a circular arc segment from the measured strain data and in step 119 computer 37 appends these data to the last similarly constructed circular arc. The appended path arc data are stored in step 121 and displayed at step 123, following which the process proceeds to step 103 to repeat for new measurement points.

The manner in which the circular arcs are constructed from strain measurements and serially appended by computer 37 in steps 115, 117 and 119 will now be described in greater detail with reference to FIGS. 9A through 16.

Figure 10A:
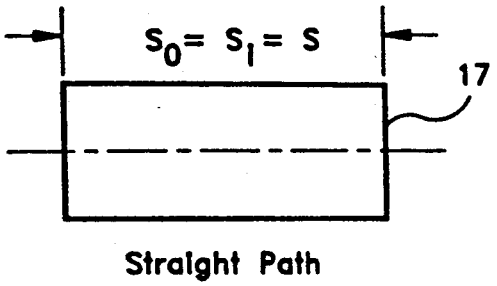
FIGS. 10A and 10B are respective diagrams of sections of a measuring instrument in an unbent and bent state which are used to explain the operation of the present invention.
Figure 10B:
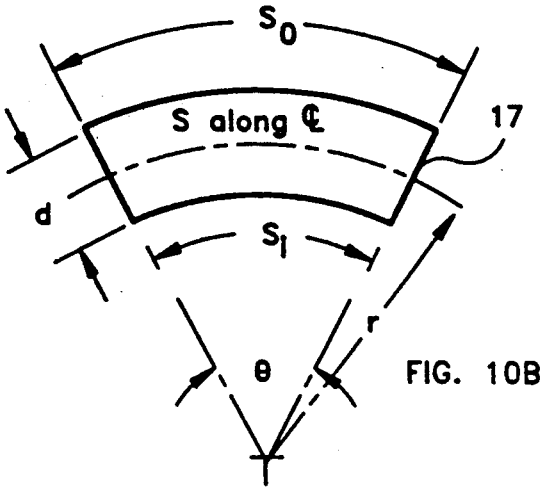
Figure 11:
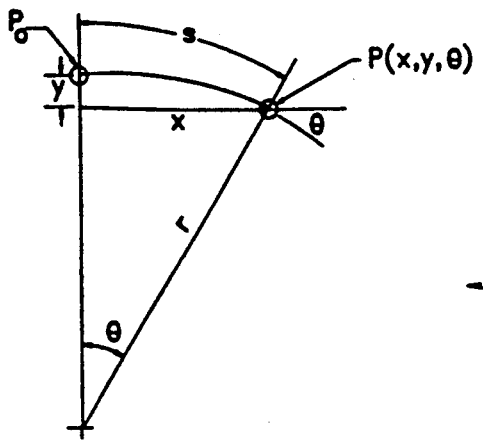
FIG. 11 is another diagram useful in explaining the operation of the invention.

FIGS. 10A and 10B respectively illustrate the tubular member 17 of measuring module 19 in unbent and bent states. As shown in FIG. 10B, member 17 has an outside arc length $S_o$, and inside arc length $S_i$ and a midline length S. All three values are equal when tubular member 17 is unbent (FIG. 10A).

When member 17 bends as the measuring module 19 traverses a passageway, as illustrated in FIG. 10B, the values $S_o$, S and $S_i$ are no longer equal. The strain which the tubular member 17 is subjected to is equal to:

$$\text{strain} = \frac{\text{change in length}}{\text{original length}} \quad (6)$$

Moreover, there is an outside strain $e_o$ and an inside strain $e_i$ due to the bending. These strains can be represented as follows:

$$e_o = \frac{S_o - S}{S} = \frac{\theta(r + d/2) - \theta r}{\theta r} = \frac{d}{2r} \quad (7)$$

$$e_i = \frac{S_i - S}{S} = \frac{\theta(r - d/2) - \theta r}{\theta r} = -\frac{d}{2r} \quad (8)$$

In addition, a differential strain exists as:

$$\Delta e = e_o - e_i = \frac{d}{r} \quad (9)$$

Figure 9A:
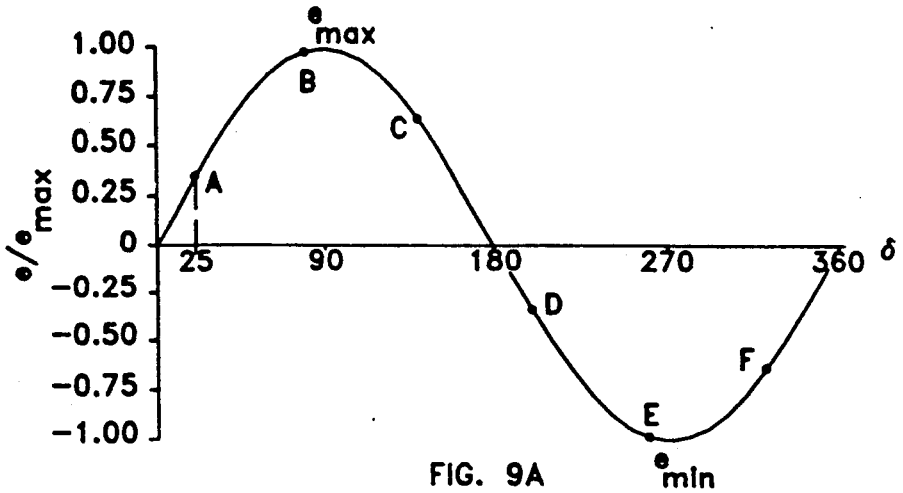
FIGS. 9A and 9B are strain measurement graphs useful in explaining the operation of the invention.
Figure 9B:
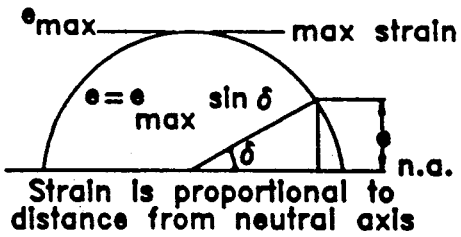

In the foregoing equations, d represents the known diameter of the pipe and the values $e_o$ and $e_i$ are the maximum $e_{max}$ and minimum $e_{min}$ values ($e_{max} = -e_{min}$) determined from the FIG. 9A curve which best fits the actual strain measurements from strain gage sensors A . . . F and equation (5), as determined in step 110. One can thus obtain the values $e_o$, $e_i$ and Δe and using equation (9), then calculate the radius of curvature r of the bent pipe as $$r = \frac{(d/2)}{\Delta e} \quad (10)$$

Once the radius of curvature r of the bent segment is known, other information useful for determining the end coordinate position of the pipe segment from an initial starting point can be derived. This derivation is illustrated for the two dimensional case in FIG. 11 using the following equations:

$$\theta = \frac{S}{r} \quad (11)$$

$$x = r \sin\theta \ldots \quad (12)$$

$$y = r(1-\cos\theta) \ldots \quad (13)$$

The foregoing equations enable one to determine the two-dimensional cartesian coordinates for point P using the determined values of $\theta$, x and y from equations (11), (12), and (13) above.

An initial point $P_O$ from which an initial segment measurement is extended is automatically surveyed accurately by the initializer 51 as described above or is entered by an operator. Using the known orientation of point $P_O$, computer 37 calculates the new end coordinate positions P (x, y, $\theta$) for a circular arc using the radius of curvature value r for the measured segment and from the calculated values of $\theta$, x and y. Computer 37 maps in memory, data representing this circular arc segment.

The foregoing analysis is in two dimensions and does not yield the orientation of the mapped curved segment in three dimensions.

Figure 12:
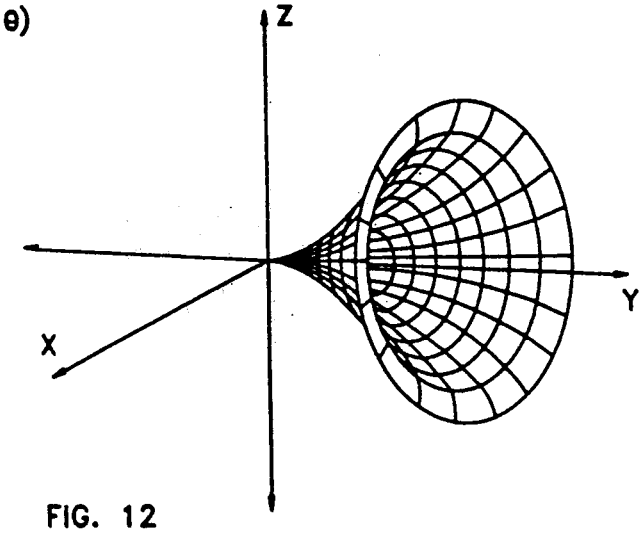
FIG. 12 is another diagram useful in explaining the operation of the invention.

FIG. 12 illustrates in three dimensions all possible orientations for a particular two dimensional segment determined from the above methodology.

In order to determine in three dimensions the orientation of the curved segment defined by end points $P_x$ and $P_{x+1}$, the present invention relies on steps 111 through 113 of FIG. 6 which provides the orientation of the circular arc represented by the cartesian coordinate for points $P_x$ and $P_{x+1}$. As shown in FIG. 9A, the plane of curvature for the illustrated measurement deviates by 25° from a reference sensor (strain sensor A) since this is how far the measured and fitted value differs from a 0° reference point. That is, the amount of deviation represents the degree by which a plane containing the measured curve segment deviates from a reference plane passing through a reference sensor A and the axis of the measuring module 19, and thus gives the orientation for the circular arc constructed in step 117. Thus, when step 117 is executed, computer 37 has information on the starting point $P_x$, ending point $P_{x+1}$, the radius of curvature and the plane in which the circular arc lies.

At step 117, computer 37 has sufficient information in three dimensions to construct the circular arc representing the bending of the measuring module 19 at a particular measurement location within a borehole. The circular arc segment representing a borehole segment under measurement has now been completed and the data representing this segment are appended to prior connected circular arcs at step 119 and the new path is stored at step 121.

Figure 13:
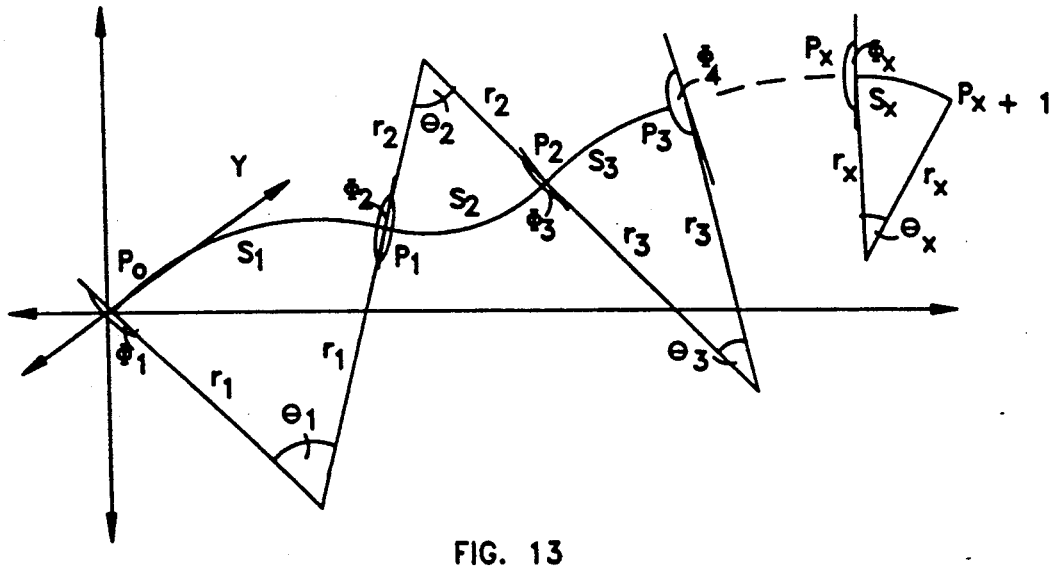
FIG. 13 is an illustration of a path formed by a series of curved arcs sequentially connected end-to-end during operation of the invention.

FIG. 13 illustrates the successive appending of circular arc segments in three dimensions by computer 37 which occurs at step 119 after steps 103–117 have been executed. The current location of measuring module 19 and the path taken through borehole 11 is next displayed in step 123. If the measuring module 19 is very close to, or part of, the drilling head 15, the most recent information provided will be for the location of the drilling head 15 in a passageway. Likewise, for other applications, if the measuring module 19 is located near a particular point whose path or location needs to be determined, the location of that point is readily and accurately provided.

In addition, a chronological map of the past locations of the measuring module 19 as it passes through the passageway is also created by the segment-by-segment construction of path data.

By pushing the measuring module 19 in increments within the borehole or passageway (step 103) and taking similar, strain gage sensor measurements and curvature calculations (steps 105–115), a series of circular arcs are successively determined (step 117) in three dimensions and end-to-end connected (step 119) by computer 37 to accurately define both the current location of the measuring module 19 as it passes through the passageway and a historical path map of the borehole (the entire series of arcs).

Vector analysis is used in steps 117 and 119 for producing each of the circular arc segments in the global three dimensional coordinate system established at the surface for each of a plurality of spaced periodic strain gage sensor measurements which are taken as the measuring module 19 is pushed through a passageway. This processing sequence is described herein in connection with FIGS. 14A and 14B, FIG. 15, and FIG. 16.

Figure 14A:
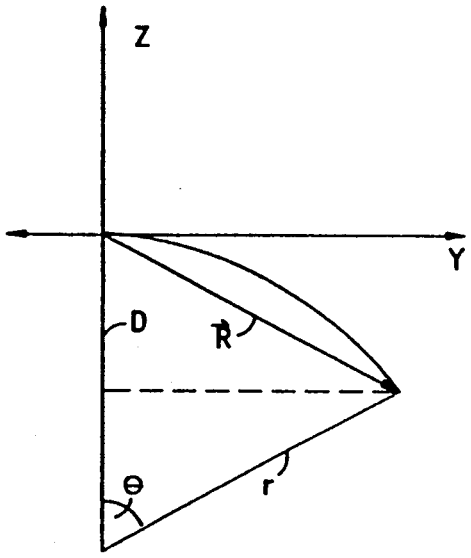
FIGS. 14A and 14B are respective illustrated segment orientation diagrams useful in explaining the operation of the present invention.
Figure 14B:
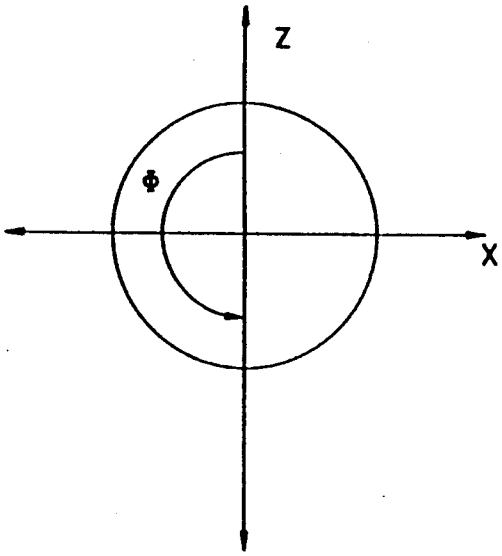

In the following vector analysis, the borehole path which is mapped is assumed to consist of a series of bends defined by the parameters shown in FIGS. 14A and 14B and defined in Table 1 below. The bends (when taken in short lengths) can be approximated as circular.

TABLE 1

| Circular Bend Parameters | |
|---|---|
| S- | Length |
| r- | Radius of curvature |
| $\theta$- | Central angle-S/r |
| $\phi$- | Counterclockwise angle from a reference point on the periphery of the pipe cross section (strain sensor A) to the radius of curvature. |
| y axis- | Local coordinate axis perpendicular to cross section of the pipe at the center of the bend origin and positive in the direction of pipe travel. |
| z axis- | Local coordinate axis along the line connecting the center of the circular pipe cross section to a reference point on the periphery of the pipe, positive towards the reference point. |
| x axis- | Local coordinate axis mutually orthogonal to local Y and Z axes. |

Figure 15:
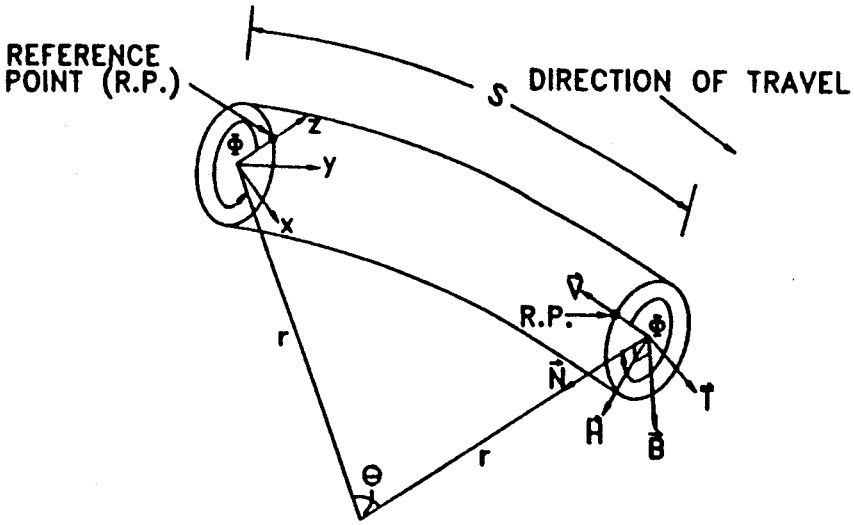
FIGS. 15 and 16 are respective additional segment diagrams useful in explaining the operation of the invention.

FIG. 15 shows a typical circular bend of measuring module 19. At the end of each bend, three vectors are defined that form the local coordinate axes of the next bend. The three vectors are $\vec{T}$, $\vec{H}$ and $\vec{V}$. $\vec{T}$ is tangent to the longitudinal axis of the pipe, $\vec{V}$ is along the line from the center of the pipe cross section to a reference point on the periphery of the pipe, and $\vec{H}$ is perpendicular to $\vec{V}$ on the plane of the pipe cross section. Vectors $\vec{B}$ and $\vec{N}$ are also defined at the end of each bend and are used in the calculation of the new local coordinate axes. They define the plane of curvature, $\vec{N}$ lying in that plane and $\vec{B}$ perpendicular to it.

The segment-by-segment construction of the path of measuring module 19 is incremental, as noted, in that at the end of each incremental push of the pipe in the borehole the angle $\theta$ and radius of curvature r are determined from strain measurements around the periphery of the pipe. Then the angle $\phi$ and vectors $\vec{T}$, $\vec{V}$, and $\vec{H}$ are calculated based on the local coordinates at the beginning of the incremental push. The vectors and $\vec{T}$, $\vec{V}$ and $\vec{H}$ are then used to define the local coordinate axes of the next push. For the very first push $\vec{T}$, $\vec{V}$ and $\vec{H}$ are measured manually, or are determined from the output of the dual axis clinometer 235 and optical encoder 240 in initializer 51.

Figure 16:
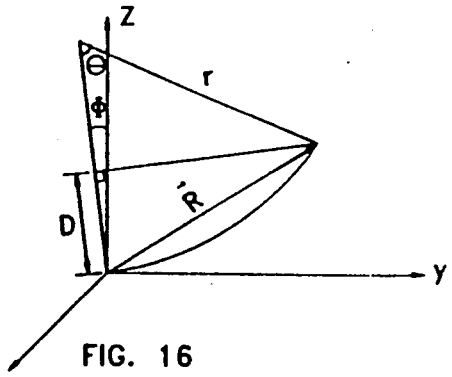

The computer 37 calculates a vector $\vec{R}$ that connects the two ends of the bend as shown in FIG. 16. Vector $\vec{R}$ is then used to calculate the global coordinates of the end point of the bend using coordinate transformation relationships.

The following is a mathematical representation of the calculation algorithm executed by computer 37 in steps 117 and 119.

The pipe path in each circular bend is mapped by vector $\vec{R}$ shown in FIG. 16. In the local coordinate system, $\vec{R}$ is defined as:

$$\vec{R} = -D\sin\phi\cdot\vec{i} + r\sin\theta\cdot\vec{j} + D\cos\phi\cdot\vec{k}\ldots \tag{14}$$

where $$D = r(1-\cos\theta)\ldots \tag{15}$$

$\vec{i}$, $\vec{j}$, and $\vec{k}$=unit vectors along the coordinate axes (x,y,z).

Note that $\phi$ and r are determined at the start of the bend prior to the incremental push. $\theta$ is calculated from:

$$\theta = \frac{S}{r} \tag{16}$$

where S=Pipe push length.

At the end of each circular bend, three orthogonal vectors $\vec{T}$, $\vec{N}$, and $\vec{B}$ are defined as:

$\vec{T}$ - Previously defined $\vec{N}$ - Vector along the radius of curvature $\vec{B}$ - Vector on the plane of the pipe cross section and normal to $\vec{N}$ In mathematical terms $\vec{T}$ is:

$$T = \frac{\frac{\partial\vec{R}}{\partial S}}{\left|\frac{\partial\vec{R}}{\partial S}\right|} = \frac{\frac{\partial R_x}{\partial S}\cdot\vec{i} + \frac{\partial R_y}{\partial S}\cdot\vec{j} + \frac{\partial R_z}{\partial S}\cdot\vec{k}}{\left|\frac{\partial\vec{R}}{\partial S}\right|} \tag{17}$$

where $R_x$, $R_y$, and $R_z$ are the x, y, and z components of R.

Taking the derivatives in Eq. (17) and simplifying leads to:

$$\vec{T} = \sin\phi\cdot\sin\theta\cdot\vec{i} + \cos\theta\cdot\vec{j} + \cos\phi\cdot\sin\theta\cdot\vec{k}\ldots \tag{18}$$

The vector $\vec{N}$ is defined as:

$$\vec{N} = \frac{\frac{\partial\vec{T}}{\partial S}}{\left|\frac{\partial\vec{T}}{\partial S}\right|} = \frac{\frac{\partial T_x}{\partial S}\cdot\vec{i} + \frac{\partial T_y}{\partial S}\cdot\vec{j} + \frac{\partial T_z}{\partial S}\cdot\vec{k}}{\left|\frac{\partial\vec{T}}{\partial S}\right|} \tag{19}$$

Taking the derivatives in Eq. (19) and simplifying leads to:

$$\vec{N} = -\sin\phi\cdot\cos\theta\cdot\vec{i} - \sin\theta\cdot\vec{j} + \cos\phi\cdot\cos\theta\cdot\vec{k}\ldots \tag{20}$$

The vector $\vec{B}$ is the cross-product of $\vec{T}$ and $\vec{N}$:

$$\vec{B} = \vec{T}\times\vec{N}\ldots \tag{21}$$

or $$\vec{B} = \cos\phi\cdot\vec{i} + 0\cdot\vec{j} + \sin\phi\cdot\vec{k}\ldots \tag{22}$$

The three vectors $\vec{T}$, $\vec{N}$, and $\vec{B}$ are used to determine the local coordinate axes of the next circular bend in the path of the pipe. Representing the z axis of the next circular bend as $\vec{V}$, a simple vector addition leads to the following equation:

$$\vec{V} = \vec{B}\sin\phi + \vec{N}\cos\phi\ldots \tag{23}$$

Since $\vec{T}$ from Eq. (18) is the same as the y axis of the next bend, a vector representing the x axis of the next bend is defined as:

$$\vec{H} = \vec{T}\times\vec{V}\ldots \tag{24}$$

Note that the plane defined by $\vec{V}$ and $\vec{H}$ is in the cross section of the pipe normal to the axis of the pipe.

The equations for $\vec{T}$, $\vec{V}$, and $\vec{H}$ show that the local coordinate axes of a circular bend can be determined from those of the previous bend in the path of the pipe.

The procedure for calculation of the global coordinates of the end points of each circular bend utilizes the relationships developed above in addition to coordinate transformation relationships. Defining the unit vectors along a global coordinate system X, Y, Z as $\vec{i}$, $\vec{j}$, and $\vec{k}$, and the coordinates of the starting point of bend 1 and $X_o$, $Y_o$, and $Z_o$, then the direction cosines for global to local coordinate transformation are:

$$\lambda_{10} = \frac{\vec{H_o}\cdot\vec{i}}{|\vec{H_o}|},\ \lambda_{20} = \frac{\vec{T_o}\cdot\vec{i}}{|\vec{T_o}|},\ \lambda_{30} = \frac{\vec{V_o}\cdot\vec{i}}{|\vec{V_o}|} \tag{25}$$

$$\mu_{10} = \frac{\vec{H_o}\cdot\vec{j}}{|\vec{H_o}|},\ \mu_{20} = \frac{\vec{T_o}\cdot\vec{j}}{|\vec{T_o}|},\ \mu_{30} = \frac{\vec{V_o}\cdot\vec{j}}{|\vec{V_o}|}$$

$$\nu_{10} = \frac{\vec{H_o}\cdot\vec{k}}{|\vec{H_o}|},\ \nu_{20} = \frac{\vec{T_o}\cdot\vec{k}}{|\vec{T_o}|},\ \nu_{30} = \frac{\vec{V_o}\cdot\vec{k}}{|\vec{V_o}|}$$

where $\vec{H_o}$, $\vec{T_o}$, and $\vec{V_o}$ originate at the start of bend 1.

The vectors that translate global coordinate axes to local axes are:

$$\vec{x_1} = \lambda_{10}\cdot\vec{i} + \lambda_{20}\cdot\vec{j} + \lambda_{30}\cdot\vec{k}\ldots \tag{26}$$

$$\vec{y_1} = \mu_{10}\cdot\vec{i} + \mu_{20}\cdot\vec{j} + \mu_{30}\cdot\vec{k}\ldots \tag{27}$$

$$\vec{z_1} = \nu_{10}\cdot\vec{i} + \nu_{20}\cdot\vec{j} + \nu_{30}\cdot\vec{k}\ldots \tag{28}$$

The global coordinates of the end of bend 1 are:

$$X_1 = X_0 + \frac{\vec{R_1} \cdot \vec{x_1}}{|\vec{x_1}|} \quad (29)$$

$$Y_1 = Y_0 + \frac{\vec{R_1} \cdot \vec{y_1}}{|\vec{y_1}|} \quad (30)$$

$$Z_1 = Z_0 + \frac{\vec{R_1} \cdot \vec{z_1}}{|\vec{z_1}|} \quad (31)$$

For the second and subsequent bends the coordinates of the end points are calculated in the same way as shown above. For bend 2, the orientations of the new local axes are $\vec{H}_1$, $\vec{T}_1$, and $\vec{V}_1$. These vectors are also calculated in the second bend and are used to calculate $\vec{H}_2$, $\vec{T}_2$, and $\vec{V}_2$ for the third bend.

The vector connecting the end points of bend 2 is $\vec{R}_2$:

$$\vec{R_2} = R_{x2} \cdot \vec{i} + R_{y2} \cdot \vec{j} + R_{z2} \cdot \vec{k} \ldots \quad (32)$$

where $$R_{x2} = -D \sin\phi \ldots \quad (33)$$

$$R_{y2} = r \sin\theta \ldots \quad (34)$$

and $$R_{z2} = D \cos\phi \ldots \quad (35)$$

Note that $\phi$ and $\theta$ are calculated from strain measurements at the start of bend 2.

The nine direction cosines for bend 2 are now equal to:

$$\lambda_{11} = \frac{\vec{H_1} \cdot \vec{x_1}}{|\vec{H_1}|}, \lambda_{21} = \frac{\vec{T_1} \cdot \vec{x_1}}{|\vec{T_1}|}, \lambda_{31} = \frac{\vec{V_1} \cdot \vec{x_1}}{|\vec{V_1}|} \quad (36)$$

$$\mu_{11} = \frac{\vec{H_1} \cdot \vec{y_1}}{|\vec{H_1}|}, \mu_{21} = \frac{\vec{T_1} \cdot \vec{y_1}}{|\vec{T_1}|}, \mu_{31} = \frac{\vec{V_1} \cdot \vec{y_1}}{|\vec{V_1}|}$$

$$\nu_{11} = \frac{\vec{H_1} \cdot \vec{z_1}}{|\vec{H_1}|}, \nu_{21} = \frac{\vec{T_1} \cdot \vec{z_1}}{|\vec{T_1}|}, \nu_{31} = \frac{\vec{V_1} \cdot \vec{z_1}}{|\vec{V_1}|}$$

Vectors representing global axes in terms of the new local system are:

$$\vec{x_2} = \lambda_{11} \cdot \vec{i} + \lambda_{21} \cdot \vec{j} + \lambda_{31} \cdot \vec{k} \ldots \quad (37)$$

$$\vec{y_2} = \mu_{11} \cdot \vec{i} + \mu_{21} \cdot \vec{j} + \mu_{31} \cdot \vec{k} \ldots \quad (38)$$

$$\vec{z_2} = \nu_{11} \cdot \vec{i} + \nu_{21} \cdot \vec{j} + \nu_{31} \cdot \vec{k} \ldots \quad (39)$$

The coordinates at the end of bend 2 are:

$$X_2 = X_1 + \frac{\vec{R_2} \cdot \vec{x_2}}{|\vec{x_2}|} \quad (40)$$

$$Y_2 = Y_1 + \frac{\vec{R_2} \cdot \vec{y_2}}{|\vec{y_2}|} \quad (41)$$

$$Z_2 = Z_1 + \frac{\vec{R_2} \cdot \vec{z_2}}{|\vec{z_2}|} \quad (42)$$

The present location data available at step 123 (FIG. 6) may be used to automatically steer drilling head 15 to a target location with the directional control system 45 illustrated in FIG. 3.

Figure 17:
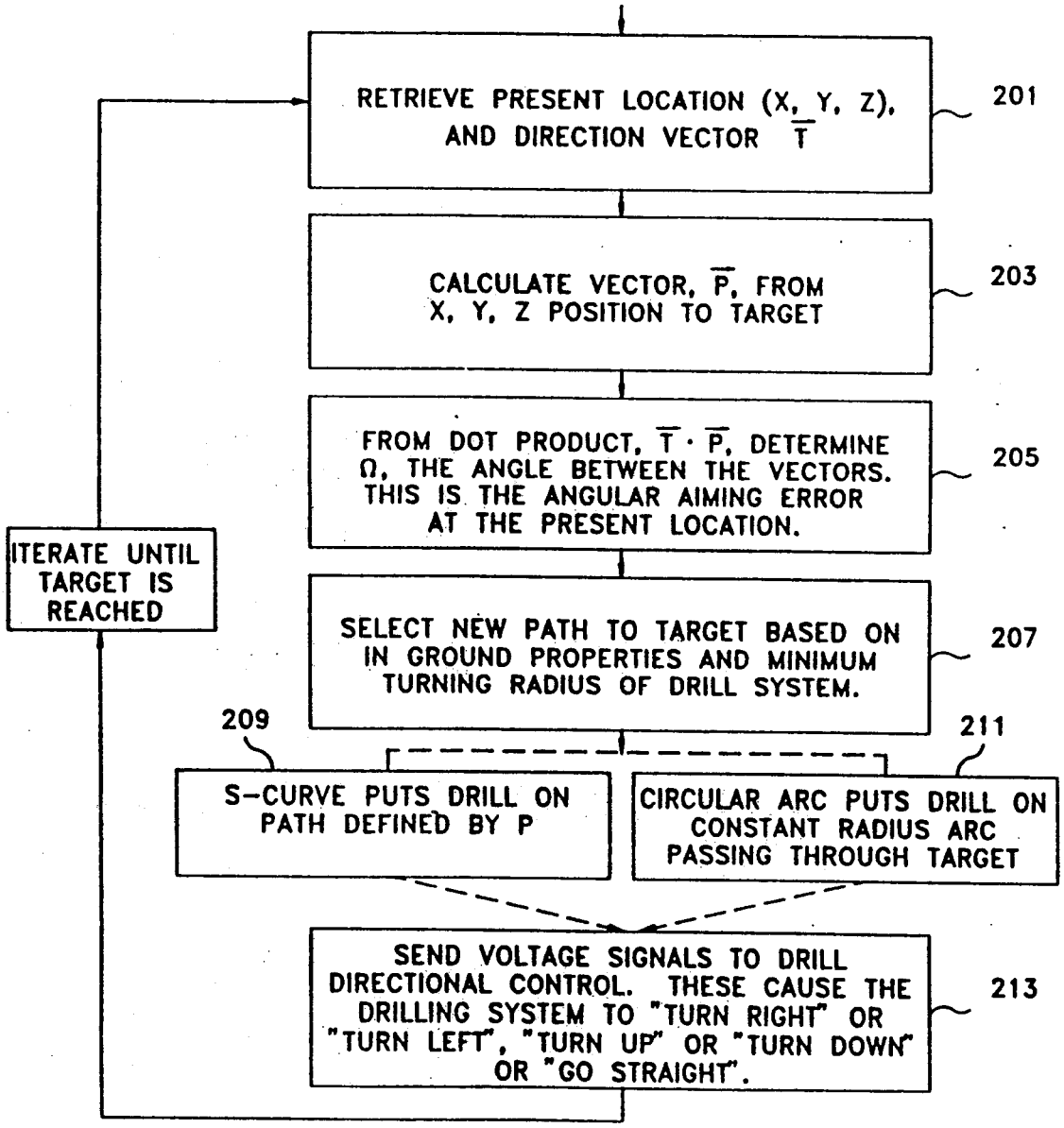
FIG. 17 illustrates the processing which occurs to obtain automatic directional drilling commands.

The directional control system 45 includes a computer and the processing performed by the computer is illustrated in greater detail in FIG. 17. In step 201 the present location coordinate (x,y,z) and direction vector $\vec{T}$ stored by computer 37 are retrieved from memory. Then, in step 203, the directional control system computer calculates a direction vector $\vec{P}$ representing the direction drilling head 15 should take from its current location in order to reach the predetermined target destination. A dot product $\vec{T} \times \vec{P}$ is then formed in step 205 to provide a value $\Omega$ representing the deviation angle between the vectors in step 205. From the value $\Omega$ a new path to a target is determined in step 207, considering the physical limitations in bending of the drill pipe 13 and possible obstacles between the present and target locations. One of two possible aiming approaches 209 or 211 is then used to steer drilling head 15. In step 209 the drilling head 15 is placed on an S curve path defined by $\vec{P}$ which will bring it back on to its original path to the target. In step 211, a constant radius circular arc is formed which passes through the target location. In either case, directional voltage signals to operate a steering mechanism to place the drilling head 15 on the selected path (defined by steps 209 or 211) are produced at step 213. These signals are sent to the drilling head steering mechanism (47 in FIG. 3).

Although FIG. 3 shows a separate directional control system computer 45 for developing the steering control signals, it should be apparent that computer 37 could also perform this task by executing steps 201–213 of FIG. 17 after step 123 in the FIG. 6 processing sequence.

The steering control output signals are supplied to the steering mechanism 47 for the drilling head 15.

As noted earlier, two separate measuring modules 19, 21 are used to continually map the path of measuring module 19 as it travels through the borehole. The purpose of measuring module 21 will now be described. The two modules 19 and 21 are identical in construction and operation and are in close proximity to one another so there is no twist between them and the orientation of the strain gage sensors in one module is the same as the orientation of the sensors in the other.

As the survey begins, the forward measuring module 19 is in the borehole and the trailing measuring module 21 is at the entry to the hole. The entry to the hole is the origin for the global coordinate system. A first measurement of the radius of curvature and the orientation of the plane of the radius of curvature is made from the measured strain data from the forward measuring module 19 strain gage sensors (FIG. 6; steps 103–123). The orientation of the trailing measuring module 21, which is then at the entry to the borehole is used to determine the orientation of the sensors in the hole as related to a reference plane through sensor A at the forward measuring module 19. As a result, using the mapping procedure described above, the critical characteristics of the first bend can be determined and the exact location of the forward measuring module 19 with respect to the global coordinate system and reference plane can be obtained.

The drill pipe 13 is thereafter advanced (step 104) so that the trailing measuring module 21 is at the same distance from the entry of the hole as the forward measuring module 19 was when it made its first measurement. An advance of drill string 13 may have been made by rotating the drill pipe and it is assumed for this and successive measurements deeper into the hole that the orientation of the strain gage sensors in measuring module 19 with respect to the portion of the drill pipe extending from the hole cannot be relied upon due to twists in the drill pipe or rotation of the same during drilling. Thus, the orientation of the strain gage sensors of the measuring module 19 with respect to the global coordinate system is unknown. However, the orientation of the plane of the bend of the drill hole which was measured during the first measurement by leading measuring module 19 has not changed. The trailing measuring module 21, which is now at the exact location where that determination was made, can take a reading to find how the sensors are oriented with respect to this known plane in the global coordinate system. Once the orientation of the trailing measuring module 21 sensors is known, this information can be provided to convert the reference for the forward measuring module 19. The forward measuring module 19 then is read (steps 105–113) and computer 37 calculates in step 113 the exact location of this new position of the forward measuring module 19 with the reference for the azimuth data reestablished from data from the trailing module 21 read at step 111. The cycle continues with the trailing measuring module 21 taking measurements at the exact location where measurements were taken by the forward measuring module 19 during the previous measurement. In this way the orientation of the strain gage sensors relative to a reference plane is carried forward in the mapping process.

Figure 18:
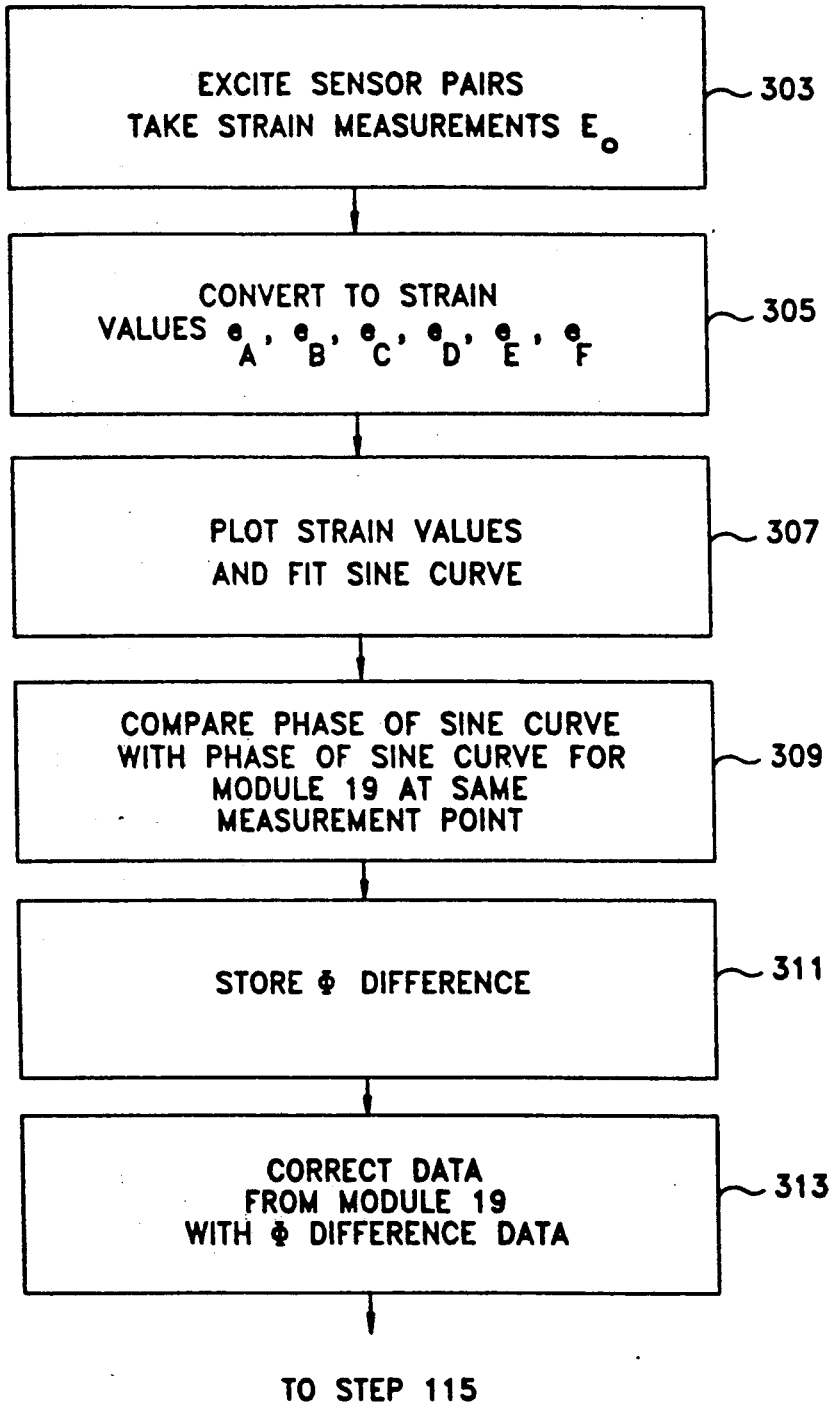
FIG. 18 illustrates the processing which occurs to obtain correction data.

The processing sequence for acquiring and using the reference correction data from trailing module 21 is illustrated in FIG. 18 as a subroutine executed as part of step 113 in FIG. 6. In step 303 the sensor pairs of trailing module 21 are excited to obtain strain measurements which are converted to strain values in step 305. These values are plotted to fit a sine curve in step 307. This phase of this curve is then compared with the phase of the curve obtained by measuring module 19 when it was at the same measuring point. This phase difference, stored in step 301, represents the rotation of measuring module 19 from the rotary position it had when the last measurement was taken and is used to correct the data obtained from measuring module 19 prior to execution of step 115 in FIG. 6.

As demonstrated above, the invention provides both a method and apparatus for determining with accuracy the location of a measuring module 19 attached to a member inserted into a passageway. Although the invention has been particularly described with respect to use in drilling a borehole, it should be appreciated that the invention may be extended to use with any linear member which undergoes bending when inserted into a curved passageway.

The invention also provides a method and apparatus for factoring out positional errors which may be present due to rotation or twisting of the drill pipe 13 during a drilling operation. This occurs by correcting azimuth data determined from a measurement taken by measuring module 19 by determining the need for and amount of correction using data acquired by the trailing measuring module 21. Thus, the system has the capability of using the azimuth data comparison between the forward and rearward measuring modules 19 and 21 to continuously correct azimuth data obtained from the forward measuring module 19 as it passes through the borehole 11.

Although the measuring instrument has been illustrated as an elongated hollow tube, it should also be appreciated that it may take other forms such as an elongated rod or beam, depending on the environment of use.

As evident from the foregoing, the invention is capable of providing a circular arc segment-by-segment construction of a three dimensional path for a measuring module 19 which will provide the current location of the measuring module 19 in a borehole as well as a chronological path map. Display module 39 can then be used to display in three dimensions the path of the measuring module 19 and its location. This provides an operator with the precise and instantaneous location of the measuring module 19. The information may also be displayed in the form of present location versus target path location to enable an operator of a drilling head or other manipulation apparatus to accurately direct the drilling head to a target location.

In addition, since the actual measurement apparatus involves the placement of strain gage sensors on the exterior of an otherwise conventional insertion member such as a drill pipe 13, the invention can be readily used with existing equipment without considerable modification. For borehole drilling, the invention can provide a clear inner space on a drill pipe 13 for the passage of drilling fluids down to a drilling head 15. This allows a smaller diameter drill pipe 13 to be employed.

The invention also has applicability to position location in any confined passage including certain cavity passageways in the human body, and curved pipes and conduits in machinery or structures. Thus, the invention has applicability beyond the field of borehole drilling and is not limited thereto.

While preferred embodiments of the invention have been described and illustrated, it should be understood that many modifications may be made to the invention without departing from the spirit and scope thereof. Accordingly, the invention is not limited by the foregoing description, but is only limited by the scope of the appended claims

We claim:

1. A method for determining, in three dimensions, at least one of (a) the path of a passageway and (b) the location of a measuring instrument in the passageway, comprising the steps of:

moving a measuring instrument through said passageway;

determining the local radius of curvature of said measuring instrument and the associated azimuth of the plane of curvature with respect to said instrument at each of a plurality of measurement points as said measuring instrument moves through said passageway;

forming a circular arc segment in three dimensional space representing each determined local radius of curvature; and constructing a three dimensional representation of at least one of (a) the path of said passageway and (b) the location of said measuring instrument, by sequentially connecting end-to-end the circular arc segments.

2. A method as in claim 1 further comprising the step of displaying said three dimensional representation.

3. A method as in claim 1 wherein the step of displaying said three dimensional representation displays the location of the measuring instrument.

4. A method as in claim 1 wherein the step of displaying said three dimensional representation displays the path of the passageway.

5. A method as in claim 1 wherein said measuring instrument is one of a tube, rod, and beam and wherein each said local radius of curvature measuring step comprises the steps of measuring the axial strain in a wall of said measuring instrument at a plurality of points around the circumference thereof and transforming the measured axial strain into a local radius of curvature measurement.

6. A method as in claim 5 wherein each said local radius of curvature measurement further comprises the steps of normalizing the axial strain measurements to a reference and determining from said normalization the azimuthal orientation of a plane of curvature of said measuring instrument with respect to said reference.

7. A method as in claim 5 wherein the axial strain is measured at a plurality of points around an outer surface of said measuring instrument.

8. A method as in claim 1 further comprising the step of determining the initial orientation of said passageway relative to a reference coordinate system, said initial orientation being used to begin the construction of said three dimensional representation from the circular arc segments.

9. A method as in claim 1 further comprising the step of:

periodically determining information on the rotational deviation of said measuring instrument from a predetermined rotational position with respect to a reference point and relative to a prior measured azimuth and using said rotation deviation information to correct the periodic measurement of the azimuth associated with a next measured local radius of curvature.

10. A method as in claim 1 further comprising the step of directing a drilling tool to a target drilling location using said three dimensional representation.

11. A method as in claim 5 wherein said axial strain is measured at a plurality of pairs of measurement points spaced around the circumference of said measuring instrument, each pair of measurement points being spaced by 180°, said azimuth measurement associated with each radius of curvature measurement being determined by normalizing the axial strain measurement at said plurality of points to a reference curve and determining from said normalization the azimuthal orientation of a plane of curvature of said tube with respect to a reference coordinate system.

12. A method as in claim 3 further comprising the step of displaying a target location together with the location of said measuring instrument.

13. A method as in claim 1, wherein the path of a passageway is determined and said three dimensional representation is of the path of said passageway.

14. A method of claim 1, wherein the location of a measuring instrument is determined and said three dimensional representation is of the location of said measuring instrument.

15. An apparatus for determining in three dimensions at least one of (a) the path of a passageway, and (b) the location of a measuring instrument in a passageway, comprising:

means for determining the local radius of curvature of a measuring instrument and an associated azimuth in three dimensions at each of a plurality of measurement points as said measuring instrument moves through said passageway;

means for forming a circular arc segment in three dimensional space representing each determined local radius of curvature;

means for storing data representing said circular arc segments; and means responsive to said stored data for forming a three dimensional representation of at least one of (a) the path of said passageway, and (b) the location of said measuring instrument in said passageway.

16. An apparatus as in claim 15 further comprising means for providing a three dimensional display of at least one of the (a) path of said passageway and (b) the location of said measuring instrument.

17. An apparatus as in claim 16 wherein said three dimensional display is a display of the path of said passageway.

18. An apparatus as in claim 16 wherein said three dimensional display is a display of the location of the measuring instrument.

19. An apparatus as in claim 18, wherein said display means also displays a target location.

20. An apparatus as in claim 15 wherein said measuring instrument is one of a tube, rod, or beam and wherein said periodically determining means comprises:

means for measuring the axial strain in the wall of said measuring instrument at a plurality of points around the circumference thereof; and means for transforming the measured axial strain into data representing a local radius of curvature.

21. An apparatus as in claim 20 wherein said periodically determining means further comprises:

means for normalizing the axial strain measurements to a reference and for determining from the normalization the azimuthal orientation of a plane of curvature of said measuring instrument with respect to said reference.

22. An apparatus as in claim 15 further comprising means for determining the initial attitude of said passageway relative to a reference coordinate system.

23. An apparatus as in claim 15 further comprising:

means for periodically determining information representing the amount of rotational deviation of said measuring instrument between a current and prior measurement; and means for using said rotational deviation to correct the next determination of the azimuth associated with a determined local radius of curvature.

24. An apparatus as in claim 15 further comprising means for controlling the position of a directionally controllable drilling tool using data representing the three dimensional representation.

25. An apparatus as in claim 15, wherein the path of a passageway is determined and said three dimensional representation is of the path of said passageway.

26. An apparatus as in claim 15, wherein the location of a measuring instrument is determined and said three dimensional representation is of the location of said measuring instrument.

* * * * *